US006302554B1

(12) United States Patent
Holce

(10) Patent No.: US 6,302,554 B1
(45) Date of Patent: Oct. 16, 2001

(54) HAIR BARRETTE MOUNT FOR ELECTRO-LUMINESCENT LIGHT AND RETROREFLECTIVE MATERIAL

(76) Inventor: Mary E. Holce, Rt 1 Box 184-B Beet Rd., Walla Walla, WA (US) 99362

( * ) Notice: Subject to any disclaimer, the term of this patent is extended or adjusted under 35 U.S.C. 154(b) by 0 days.

(21) Appl. No.: 09/436,544

(22) Filed: Nov. 8, 1999

(51) Int. Cl.[7] ..... F21V 9/16
(52) U.S. Cl. ..... 362/84; 340/573.3; 362/104
(58) Field of Search ..... 362/104, 84, 105; 428/917; 119/859; 340/573.1, 573.3

(56) References Cited

U.S. PATENT DOCUMENTS 4,912,944 * 4/1990 Crosley ..... 63/29.2
5,398,705 * 3/1995 Hiltbrand ..... 132/275
5,840,405 * 11/1998 Shusta ..... 428/156
5,996,593 * 12/1999 Horman ..... 132/278
6,086,213 * 7/2000 Holce ..... 362/84

* cited by examiner

*Primary Examiner*—Alan Cariaso
*Assistant Examiner*—Hargobind S. Sawhney

(57) ABSTRACT

The present invention provides the general public, especially equestrians, an assembled illuminating hair barrette mount, which is clipped into hair or horse's tails. A portable, injection molded electro-luminescent (EL) light will optionally attach to the substantially flexible top surface material, which is made in a desired shape, and which is attached to a rigid barrette, and to the barrette itself.

An option with this invention is the attachment of retroreflective materials, covering the majority of the top surface of the material attached to the barrette, which will reflect incident light produced by an approaching car. Another option is incorporating the use of electro-luminescent light used in conjunction with retroreflective materials on the barrette mount, which enhances the safety function of the barrette mount.

14 Claims, 2 Drawing Sheets

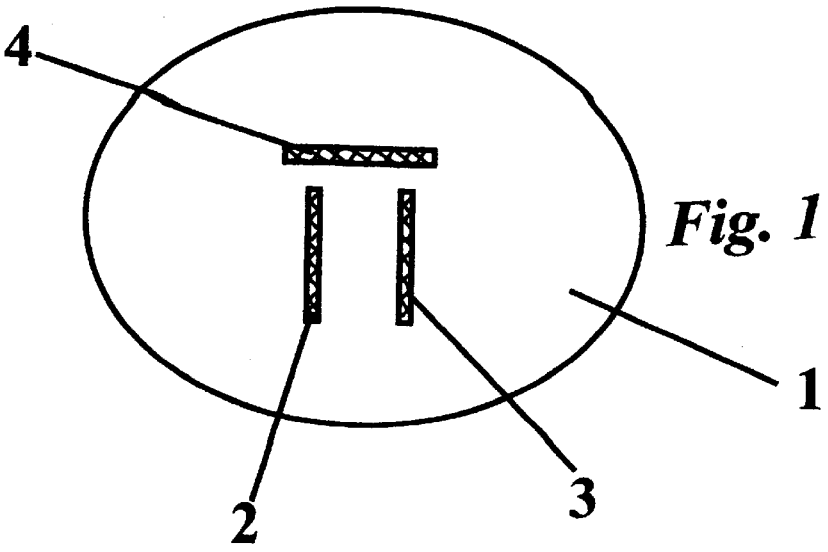
Fig. 1
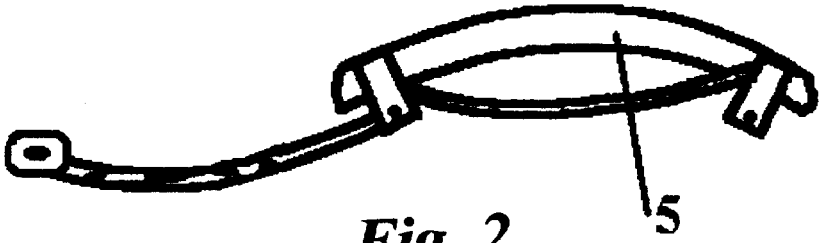
Fig. 2
Fig.4
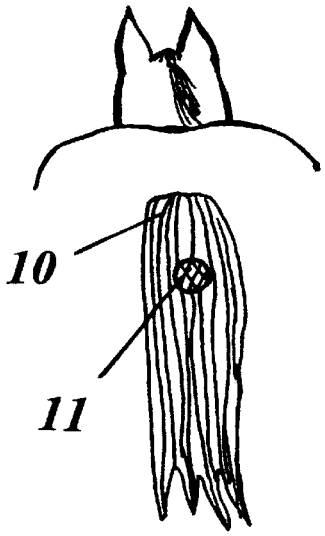
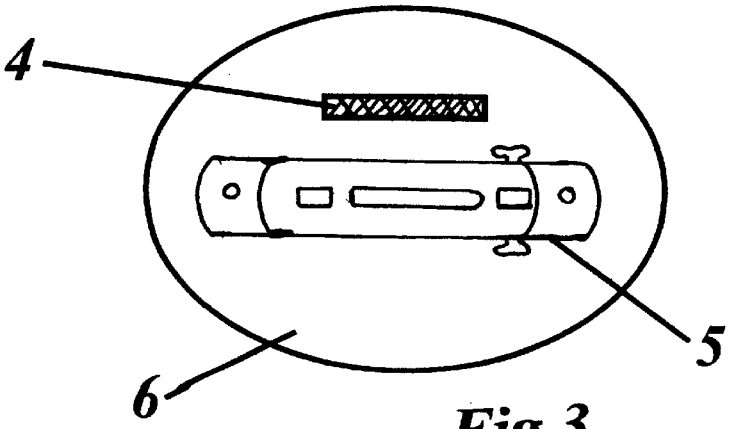
Fig.3

Fig.5
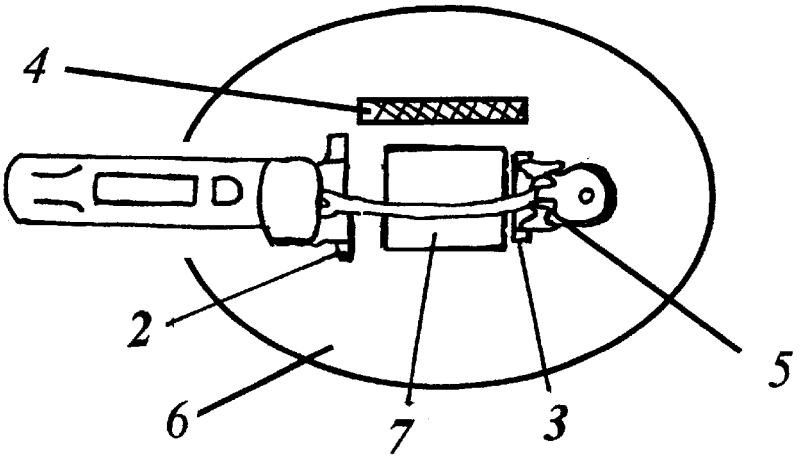
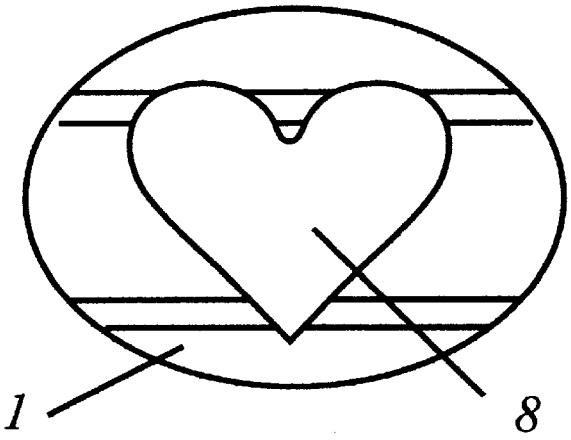
Fig.6
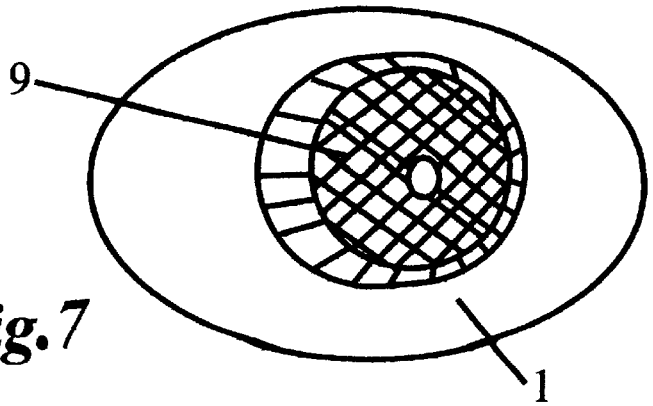
Fig.7

HAIR BARRETTE MOUNT FOR ELECTRO-LUMINESCENT LIGHT AND RETROREFLECTIVE MATERIAL

CROSS-REFERENCE TO RELATED APPLICATIONS

"Not Applicable"

STATEMENT REGARDING FEDERALLY SPONSORED RESEARCH OR DEVELOPMENT

"Not Applicable"

REFERENCE TO A MICROFICHE APPENDIX

"Not Applicable"

BACKGROUND OF THE INVENTION

This invention relates generally to hair barrettes, and the use of electro-luminescent (EL) lights, which may include a plurality of light emitting elements, and reflective elements, used for attachment to a person's hair, to provide enhanced visibility of the wearer, and safety.

Ornamental hair attachments, with ribbons or decorations are well known. The use of EL light assemblies are well known. Patents researched for this application include: U.S. Pat. Nos. 5,497,307 5,727,577, 5,934,784, 5,018,053, 5,785,065, and 5,947,580. In U.S. Pat. No. 5,947,580 we are shown an example of one type of universal EL light which would readily attach to this mount, using the described injection molded EL light which has a molded clip or hook, as shown on it's reverse surface in drawing FIG. 1-1 of U.S. Pat. No. 5,947,580. U.S. Pat. No. 5,947,307 discloses attachment of the EL light to a shoe, or bicycle, which is quite different from this invention. There is given the option of attaching to a person. But there is no mention in U.S. Pat. No. 5,947,307 of attaching this EL light to a barrette mount, and no means given to do so. In many instances, additional means of attachment of this type of light to a person or animal are needed.

My barrette mount assembly does not need to patent a new EL light. My barrette mount was invented to make their use possible, which has been difficult in many situations. The various portable, small, often flashing EL lights available, clip easily to clothing, but difficulty arises when wanting to attach them to hair.

In U.S. Pat. No. 5,497,307 we are shown illuminating jewelry, which is motion sensitive, and blinks when the wearer moves. The clip in U.S. Pat. No. 5,497,307 is a clip to attach to a person, and no mention of a hair barrette is given. A cap arrangement is shown inside of which is enclosed a light bulb, which is joined to the batteries which are enclosed into an envelope using conductive wires. My barrette mount is an electro-luminescent light mount, uses a portable electro-luminescent light, and no envelope and cap arrangement is needed for it to work.

In U.S. Pat. No. 5,785,065 we are shown a hair barrette with replaceable ornaments. The shown snap on connecting device is shown to clamp on compressible ornaments, or hair, and would not readily accept an injection molded EL light, and the art shows the spigot, clamp arrangement compressing ornamental appendages. No mention is given to EL lights, and the clamp shown would not work with them.

In U.S. Pat. No. 4,998,186 we are shown a hair comb clip, which provides optic fibers attached in a decorative manner.

My barrette mount does not need to use optic fibers. They could be attached for additional decoration, but the true intention of the barrette mount is a safety function, not a decorative function.

In U.S. Pat. No. 5,318,054 we are shown a spiral spring hair barrette assembly, which consists of a spiral spring to which the comb is attached. The barrette assembly is designed to coil around the ponytail hair, and can have additional decorative fabric. My barrette mount does not coil around a ponytail to hold the hair. It clips easily into the hair.

In U.S. Pat. No. 5,018,053 we are shown illuminated jewelry where a lead post is secured to the light source and positioned to contact the opposite terminal of the power source to energize the light. A lead finding is pivotally secured to the retainer at one end, and is secured at the opposite end to the light source. When opened and shut, the clip itself turns the light on and off. The art discloses a definite difference in the workings of the illuminated jewelry. My barrette mount does not have a hinge function to turn a light on or off, and uses a portable EL light, with no need for a lead wire arrangement.

In U.S. Pat. No. 5,934,784,we are shown a ball assembly with a flasher, which attaches to the wearer by means of elastic. The current invention does not use any elastic on the mount, and connects to a person's hair by means of a rigid barrette.

In U.S. Pat. No. 5,441,061 we are shown a decorative ornamental barrette which has a clamping coupling member, which will hold decorative ornaments for display. The clamp assembly has the decorative elements threaded through openings through the coupling member. My barrette mount is not a barrette of this configuration.

In U.S. Pat. No. 5,727,577 we are shown an optical ornament utilizing a plurality of optic fibers which extend outward from the assembly. My barrette mount does not need a plurality of optic fibers, and instead uses very bright electro-luminescent lights for safety purposes.

BRIEF SUMMARY OF THE INVENTION

My invention is an assembled reflective or illuminated hair barrette, that will provide a previously needed safety product, for any horse's tail or forelock, or person's hair.

Difficulty in using injection-molded, portable EL lights made it necessary to invent and improve means to make their use possible. The unforeseen difficulty became apparent when users of injection molded EL lights tried to attach them to animals. My barrette mount was invented to overcome, and provide a remedy for the difficulties. The portable EL lights often have a hook on their reverse surface, which will not attach to hair without my barrette mount. A novel result was discovered when the hair barrette mount-with an EL light attached, and retroreflective materials, was used in a horse's tail, and the horse, which is by nature a suspicious animal, could not see or feel my barrette mount attached to the tail, and took no notice of it. Because horses are color-blind to many colors, my barrette mount did not frighten them. There is a very great need for safety products by equestrians who are confronting traffic, to have a light in the horse's tail. My barrette mount will stay very well in a horse's tail, even when the animal is swatting his tail at flies. This invention can be applied to the horse's forelock, or a person's hair as well.

Another problem associated with the portable electro-luminescent lights, was found when the lights were not in use, and not attached to a mount of some sort. They would be misplaced easily, and often run through the washer in a pocket of clothing. My barrette mount is larger, and would not be so readily lost in a pocket.

My barrette mount provides an assembled, illuminating hair barrette mount which is easily clipped into horse tails, or hair. The main function of the hair barrette will be to make the wearer highly visible to approaching traffic. When used by an equestrian in a dark parking lot, or horse show, being visible to other pedestrians and equestrians on the show grounds is desirable. This barrette mount will also be advantageous to dog-walkers, and pedestrians, for attachment to their hair.

Using portable EL lights, this barrette mount will be seen for a great distance. Shown as an example, the preferred injection molded EL lights will readily attach facing outward, to the flexible top surface material which has three predetermined slots, and which is glued or riveted to a rigid barrette clip, and/or to the barrette clip itself, by engaging the molded clip or hook which may be on the EL light's reverse surface, or alternatively hook and loop is used.

There are over three different manufacturers who produce the preferred styles of portable electro-luminescent lights used in this invention. These lights generally have an on/off switch, and run on small internal batteries.

An option for my barrette mount is the attachment of retroreflective materials covering the majority of the top surface of the hair barrette, which will reflect incident light produced by an approaching car. The retroreflective materials are outstanding in their brilliance, and are a product rarely used by the general public, or equestrians.

Additionally the retroreflective material may be used in conjunction with electro-luminescent light.

The top surface of the barrette and retroreflective material may be of any size or shape, or be screen printed.

I would like to patent the often needed barrette mount, and assembled product, produced by this invention. My barrette mount will allow the general public, and especially equestrians, a new safety product.

BRIEF DESCRIPTION OF THE DRAWINGS

FIG. 1 illustrates the top surface of the barrette mount, wherein three slots or openings perforate the barrette mount.

FIG. 2 illustrates a barrette which will readily attach to this barrette mount.

FIG. 3 illustrates the reverse surface of the barrette mount, upon which is attached a barrette shown in FIG. 2, and also a slot or opening is seen.

FIG. 4 illustrates a novel way of using the barrette mount by attaching it to the tail of a horse.

FIG. 5 illustrates the reverse surface of the barrette mount assembled with the flexible material upon which is attached the barrette, as shown in FIG. 2, excepting that the barrette is in the open position, by using the slots or openings in the flexible material, with the addition of another piece of material reinforcing the attachment of the barrette. Also a slot or opening in the flexible material is shown.

FIG. 6 illustrates the application of retroreflective materials covering a majority of the top surface of the barrette mount.

FIG. 7 illustrates an electro-luminescent light attached to the barrette mount.

DETAILED DESCRIPTION OF THE INVENTION

Referring to the drawings, on page 1/2, FIG. 1 includes 1 the top surface of the barrette mount made up of substantially flexible material cut into a desired shape, where 2 a vertical slot or opening and 3 a vertical slot or opening, is arranged at a 90 degree angle from 4 a horizontal slot or opening. The 4 horizontal slot or opening is ready for the optional engagement of the hook, which may be on the back surface of an electro-luminescent light, thereby joining them together.

In FIG. 2 we see the 5 rigid barrette which may be used for this barrette mount assembly shown in the opened position.

In FIG. 3 we are shown the 5 rigid barrette attached by glue to the 6 back surface of the barrette mount which is made up of substantially flexible material cut into a desired shape, and 4 a horizontal slot or opening is shown.

In FIG. 4 we see the 10 tail of a horse, which has a 11 barrette mount with one electro-luminescent light attached, clipped into the hair, and the horse is oblivious to the barrette mount in his tail.

On Page 2/2, FIG. 5 illustrates the 6 back surface of the barrette mount assembly which is made up of the substantially flexible material which is in a desired shape, and 5 the rigid barrette is slipped, while in the open position, into the 3 vertical slot and then through 2 the other vertical slot, where 5 the rigid barrette is attached to the 6 reverse surface and reinforced by using 7 a rectangular piece of flexible material glued to the 6 reverse surface, and also 4 a horizontal slot or opening is shown.

In FIG. 6 we are shown the 1 top surface of the barrette mount which has 8 a majority of the top surface area of the barrette mount covered by optional retroreflective materials, in desired shapes.

In FIG. 7 we are shown the 1 top surface of the barrette mount assembled with an example of 9 one type of optional electro-luminescent light.

What is claimed is:

1. I claim a barrette device for hair comprising the following assembled tangible parts:

a hair clasp, being rigid, narrow in width, of predetermined length and breadth, and which has a top and bottom member, said members being hinged together at one end, said members not joined at the opposite end, said bottom member being a prong having a blunt end, and said top member having a keeper on the underside, therein allowing said hair clasp to open and shut, and remain shut;

attaching to the top surface of said top member, a layer of non-rigid, flat, fabric, of predetermined size and shape including a plurality of slits in predetermined locations perforating said fabric;

inserting said hair clasp into said slits, and securing hair clasp to said fabric by using means of attachment, thereby forming a base unit;

attaching a self contained electro-luminescent light to said base unit by using means of attachment;

whereby the hair clasp device may be worn in the hair of animals as an illuminated safety device.

2. I claim a device as claimed in claim 1 further including the device is clipped to an object.

3. I claim a device as claimed in claim 1 whereby said electro-luminescent light is injection molded, portable, self-contained, runs on batteries, and has an on/off switch.

4. I claim a device as claimed in claim 1 wherein animals includes humans, livestock, and pets.

5. I claim a device as claimed in claim 1 wherein a projecting hook, which is on the reverse surface of said light, is inserted into a slit in said fabric, thereby attaching said light to said base unit.

6. I claim a device as claimed in claim 1 whereby said electro-luminescent light is attached to said hair clip by using hook and loop, wherein loop is on the reverse surface of the electro-luminescent light and engaged with hook which is on the top surface of said hair clasp base unit.

7. I claim a device as claimed in claim 1 whereby said electro-luminescent light is attached to said base unit using means of attachment necessary to assemble the device.

8. I claim a barrette device for hair comprising the following assembled tangible parts:

a hair clasp which is narrow in width, of predetermined length and breadth, and which has a top and bottom member, said members each having a top and reverse surface, said members being hinged together at one end, said members not joined at the opposite end, said bottom member being a prong having a blunt end, and said top member having a keeper on the underside, therein allowing said hair clasp to open and shut, engage the prong with the keeper, and remain shut;

attaching to the top surface of said top member, a layer of non-rigid, flat, fabric, of predetermined size and shape including a plurality of slits in predetermined locations perforating said fabric;

inserting said hair clasp into said slits, and securing hair clasp to said fabric by using means of attachment, attaching to the top surface of said fabric, flat, non-rigid, retro-reflective sheeting material cut into a predetermined size and shape;

attaching to the hair clasp device as a whole, a self contained electro-luminescent light, facing outwardly, using means of attachment;

whereby the device may be worn in the hair of animals as a safety device, and said retro-reflective material reflects incident light when said electro-luminescent light is on.

9. I claim a device as claimed in claim 8 further including the device is clipped to an object.

10. I claim a device as claimed in claim 8 whereby said electro-luminescent light is injection molded, portable, self-contained, runs on batteries, and has an on/off switch.

11. I claim a device as claimed in claim 8 wherein said animals includes humans, livestock, and pets.

12. I claim a device as claimed in claim 8 therein a projecting hook, which is on the reverse surface of said light, is inserted into a slit in said fabric, thereby engaging said light to said hair clasp device.

13. I claim a device as claimed in claim 8 whereby said electro-luminescent light is attached to said device using means of attachment necessary to assemble the device.

14. I claim a device as claimed in claim 8 whereby said retro-reflective sheeting material has a slit, into which a projecting hook, which is on the reverse surface of said electro-luminescent light, slips into, thereby engaging said electro-luminescent light to said hair clasp device.

* * * * *